US005829273A

United States Patent [19]

Weingast et al.

[11] Patent Number: 5,829,273

[45] Date of Patent: Nov. 3, 1998

[54] REVERSIBLE EARRING

[75] Inventors: Michael S. Weingast, Sharon, Mass.; Erwin Pearl, New York, N.Y.

[73] Assignee: Erwin Pearl, Inc., New York, N.Y.

[21] Appl. No.: 722,655

[22] Filed: Sep. 27, 1996

[51] Int. Cl.[6] ..... A44C 7/00

[52] U.S. Cl. ..... 63/14.5; 24/616

[58] Field of Search ..... 63/14.1, 14.4, 63/14.5; 24/616

[56] References Cited

U.S. PATENT DOCUMENTS 2,611,251 9/1952 Guth ..... 63/14.5

3,587,247 6/1971 Crisfield et al. ..... 63/14.5

3,599,444 8/1971 Demers etal. ..... 63/14.5

3,768,275 10/1973 Blumstein et al. ..... 63/14.5

*Primary Examiner*—Kien T. Nguyen

*Attorney, Agent, or Firm*—Gottlieb, Rackmanm & Reisman, P.C.

[57] ABSTRACT

A reversible clip-on earring is described herein. The reversible earring comprises a pair of curved, essentially mirror-image segments hinged together and pivotal between open and closed conditions. The hinge mechanism includes a spring hinge for urging the curved segments to a closed condition so that the earring may be clipped onto the ear lobe of a wearer.

16 Claims, 2 Drawing Sheets

REVERSIBLE EARRING

BACKGROUND OF THE INVENTION

This application relates to a reversible clip-on earring, and more particularly, to an earring design which includes a pair of curved segments hinged together and pivotal between open and closed conditions.

Clip-on earrings in general have been part of the jewelry marketplace for many years. Clip-on earrings are desirable because there is no need for the wearer to pierce his or her ears in order for the earrings to be fixed thereto.

One problem with any earring is that it may be only suitable for one type of occasion or situation, such as being worn for either business purposes, a social event, etc. Therefore, the wearer may have to change the earrings several times during the day in order to be appropriately "dressed up."

Accordingly, it would be desirable to provide an earring design in the form of a clip-on earring which overcomes the above disadvantages.

SUMMARY OF THE INVENTION

Generally speaking, in accordance with the invention, a reversible clip-on earring is described herein. The reversible earring comprises a pair of curved, essentially mirror-image segments hinged together and pivotal between open and closed conditions. The hinge mechanism includes a spring means for urging the curved segments to a closed condition so that the earring may be clipped onto the ear lobe of a wearer.

Significantly, each segment of the earring includes an outside or visible surface, namely its decorative surface. The decorative surface of one segment will desirably have a different design configuration than the decorative surface of the other segment, so that the earring can be reversibly mounted along the wearer's ear lobe, and thereby provide two different design appearances, to the benefit of the wearer.

Also of significance is the fact that the hinge mechanism is mounted in recessed areas on the inside surfaces of the curved segments adjacent to where the two segments are hingedly connected. This provides a more aesthetically appealing design, since the hinge mechanism is not readily viewable, i.e., is essential hidden, from either a side elevational or front elevational view.

Accordingly, it is an object of the invention to provide a reversible clip-on earring design.

Still another object of the invention is to provide a clip-on earring design which can be reversibly attached to the ear lobe of the wearer in order to provide two different design appearances, giving a pair of earrings great flexibility in complementing the "look" of the wearer. For example, the plain decorative surface can be worn during the day, then switched to the more elaborate gem stone decorative surface for evening wear.

Yet a further object of the invention is to provide a clip-on earring design comprising a pair of hinged segments which may be pivoted between a first closed condition and a second open condition.

Still another object of the invention is to provide a clip-on earring design having a hinge mechanism which is not readily viewable by the observer, i.e., is essentially hidden from view.

Yet another object of the invention is to provide an earring design in which the earring just "lightly" holds the ear lobe, making the earring very comfortable to wear.

Still other objects and advantages of the invention will in part be obvious, and will in part be apparent from the following description.

The invention accordingly comprises a jewelry design possessing the features, properties and relation of elements which will be exemplified in the design hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 5:
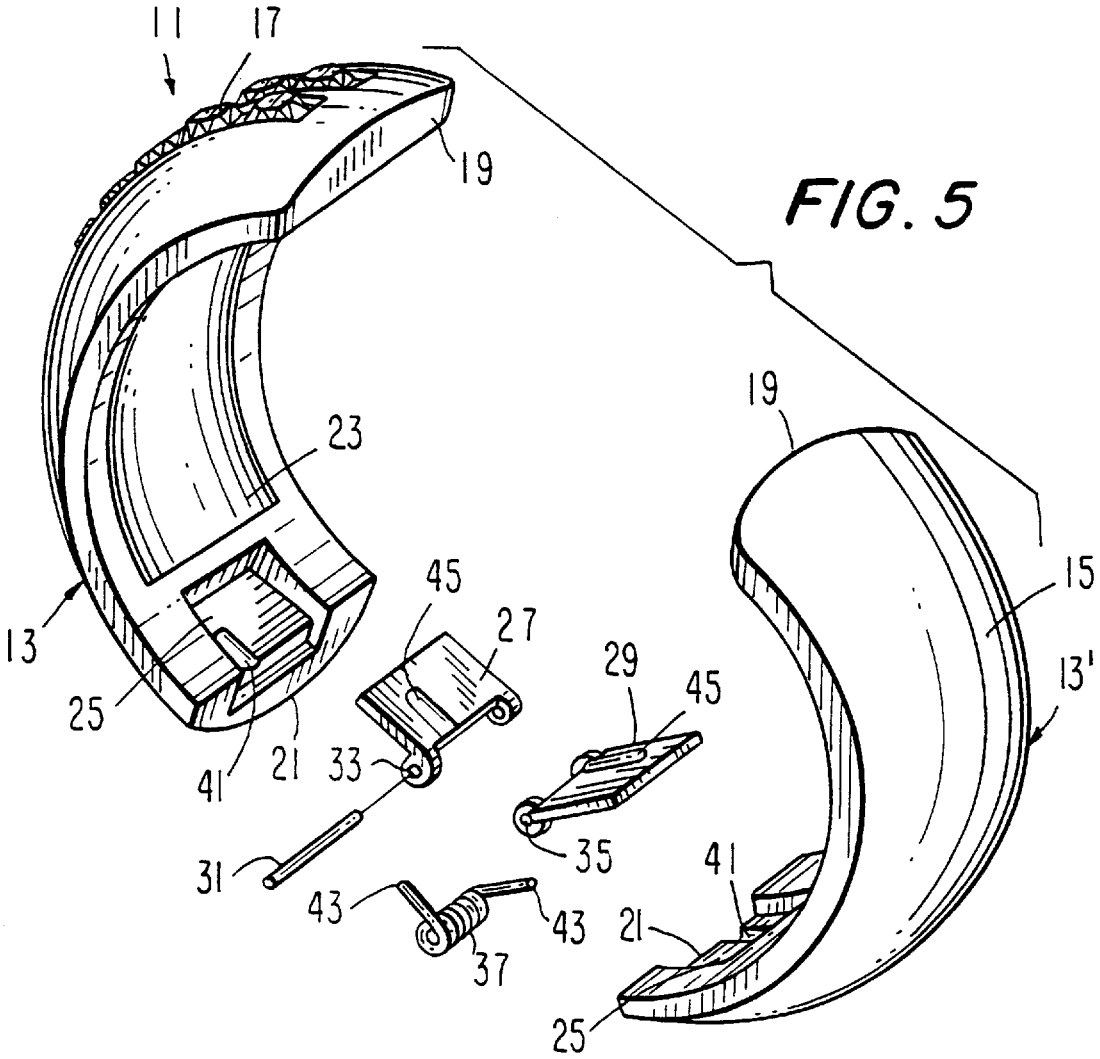
FIG. 5 is an exploded perspective view illustrating the various component parts of the reversible clip-on earring of the invention.

Referring in general to FIGS. 1–4, and in particular to FIG. 5, a reversible clip-on earring, generally indicated at 11 and made in accordance with the invention, is now described. Earring 11 comprises a pair of curved or arcuate, essentially mirror-image, segments 13 and 13' desirably formed of a precious or semi-precious metal (such as gold or silver) or is base metal plated. Segments 13 and 13' are hingedly connected to each other at one end thereof by means of a hinge mechanism generally indicated at 16. Each of curved segments 13 and 13' has an outside substantially convex decorative surface 15 and 15' respectively and an inside substantially concave surface 23. As can be appreciated, one of decorative surfaces 15 and 15' is visible when earring 11 is carried along the ear lobe of the wearer, as described in more detail below.

Figure 1:
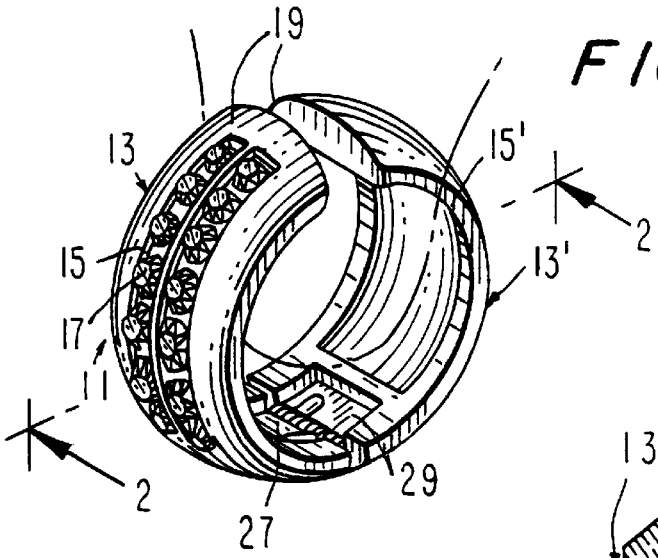
FIG. 1 is a perspective view of the reversible clip-on earring of the invention attached to a wearer's ear lobe.

Surface 15 desirably carries a different design configuration than surface 15', as best shown in FIGS. 1 and 5. By way of example, surface 15 of segment 13 includes a plurality of diamond or diamond-like stones 17 mounted therealong. In contrast, surface 15' of curved segment 13' does not include any diamonds or other stones. Instead, a gold or other metallic surface is all that is seen by the observer.

Figure 2:
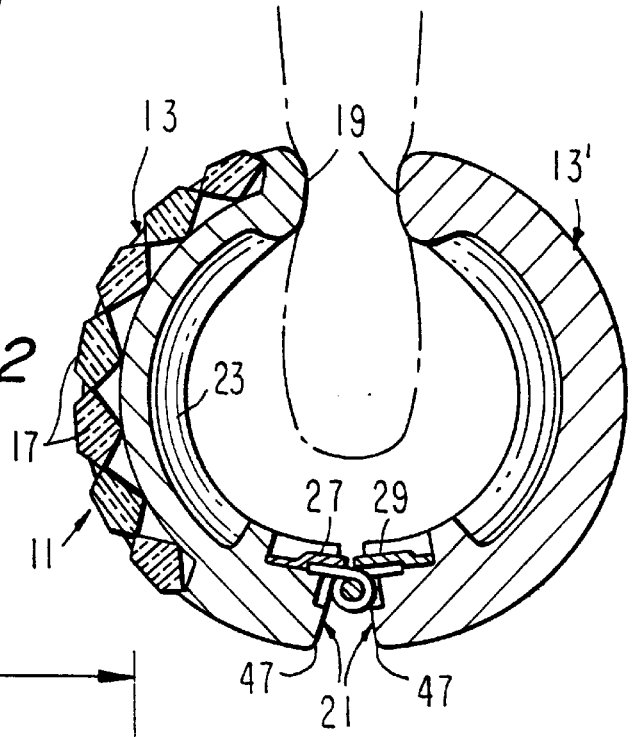
FIG. 2 is a cross-sectional view taken along line 2—2 of FIG. 1.
Figure 3:
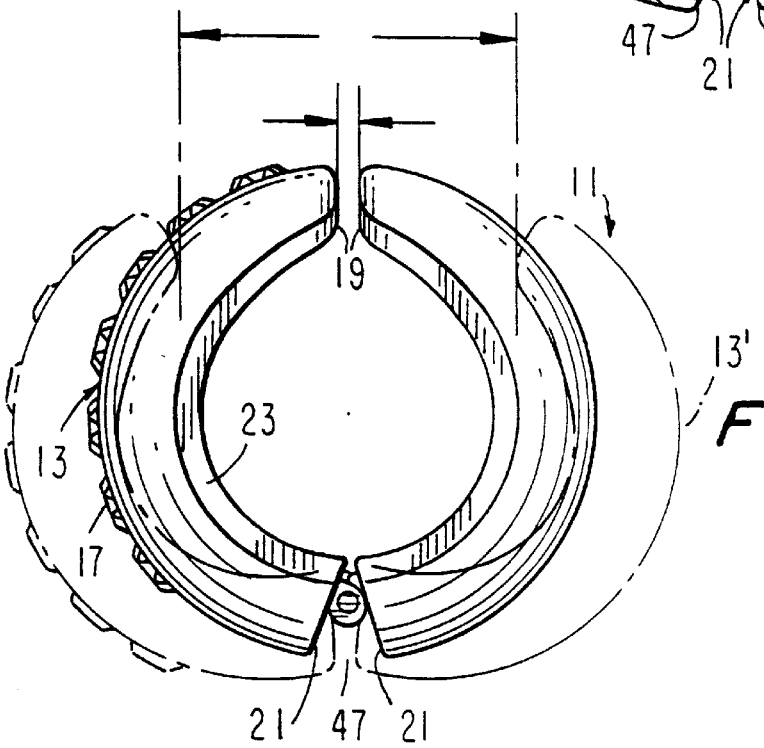
FIG. 3 is a side elevational view illustrating the reversible clip-on earring of the invention in both closed and open conditions.
Figure 4:
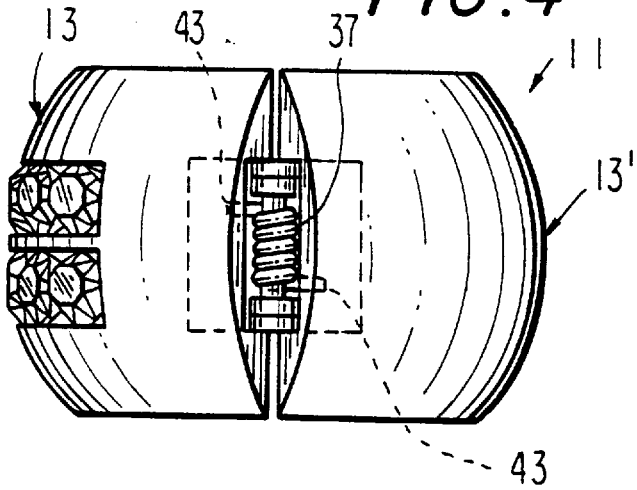
FIG. 4 is a bottom plan view of the reversible clip-on earring of the invention in a substantially closed condition.

Each of curved segments 13 and 13' have an upward or forward end 19 and a downward or rearward end 21, as seen in FIG. 3. Upward or forward ends 19 are used to grasp and hold the wearer's ear lobe when urged to a closed condition, as is best depicted in FIG. 2. Each of downward or rearward ends 21 includes a substantially planar opposed essentially rectangular recess 25 formed along inside surface 23 that is used for carrying hinge assembly 16, as now described.

Hinge assembly 16 includes a first hinge member 27 and a second hinge member 29 pivotally connected to first hinge member 27. Each of hinge members 27 and 29 are soldered in place within recesses 25 and are substantially flush with concave surfaces 23. This feature prevents hinge assembly 16 from being readily viewable when viewing earring 11 from the side or front thereof, thereby providing a more aesthetically appealing design. In fact, the hinge assembly is essentially hidden from view. Hinge member 27 includes a pair of aligned holes 33, while hinge member 29 includes a pair of aligned holes 35. Hinge members 27 and 29 are pivotally mated together by aligning holes 33 and 35 such that a pin 31 is rotatably carried therethrough.

Hinge assembly 16 further includes a spring 37 which is wrapped about pin 31 once it has been deployed through aligned holes 33 and 35 of hinge members 27 and 29. Spring 37 is wrapped sufficiently tightly about pin 31 so that it urges upward or forward ends 19 of segments 13 toward each other, as shown in FIG. 3.

Each recess 25 of segments 13, 13' has a depression 41 therein, in which one of the spring ends 43 is seated. Likewise, each hinge member 27, 29 has an indent 45 formed therein, along its underside, to receive and fix (by soldering) the same spring end.

As seen in FIG. 3 in dotted lines, when segments 13, 13' are opened to their maximum, stops 47 at the lower ends of the segments abut, preventing further opening of the earring, and thereby preventing spring 37 from being overly "wound."

In order to wear earring 13 of the invention, upward or forward ends 19 of segments 13 and 13' are urged away from each other against the force of spring 37 so that there is a sufficient distance between ends 19 for accommodating the wearer's ear lobe. Then, earring 11 is placed along the wearer's ear lobe, as shown in FIGS. 1 and 2, with surface 15 of segment 13 being visibly exposed. Spring 37 now urges upward or forward ends 19 toward each other so that ends 19 grasp the ear lobe with sufficient force in order to prevent earring 11 from coming loose.

If the wearer desires to remove earring 11, upward or forward ends 19 of segments 13 are simply manually urged away from each other, and earring 11 is slid off the ear lobe. Earring 11 then may be placed in a reversed position along the wearer's ear lobe in order to expose surface 15' of curved segment 13' as opposed to surface 15 of curved segment 13. Thus, the wearer has a desirable choice of which decorative surface to expose to view.

In the inventive earring assembly, the spring mechanism is designed such that upward or forward ends 19 will lightly grasp the ear lobe of the wearer (a "whisper touch"). Accordingly, the inventive earring is extremely comfortable when worn on the ear lobe.

It will thus be seen that the objects set forth above, among those made apparent from the preceding description, are efficiently obtained, and since certain changes may be made in the jewelry design without departing from the spirit and scope of the invention, it is intended that all matter contained in this description and shown in the accompanying drawings shall be interpreted as illustrative and not in a limiting sense.

We claim:

1. A clip-on earring for clipping onto the earlobe of an individual, said earring comprising:

a first segment with a first outer surface with a first decorative design and a first segment inner surface, said first segment being generally arcuate and having a first segment top end and a first segment bottom end;

a second segment with a second segment outer surface with a second decorative design different from said first design and a second segment inner surface, said second segment being generally arcuate and having a second segment top end and a second segment bottom end;

a spring-loaded hinge connecting said first and second segment bottom ends and being disposed on said first and second segment inner surfaces, said hinge being arranged and constructed to allow said first and second segment top ends to open and close tangentially toward each other;

with said earring being mountable on said earlobe in one of a first and a second position, wherein in said first position said first segment extends outwardly of said earlobe with said first decorative design being visible while said second segment extends inwardly behind said first segment so that said second design is substantially invisible; and wherein in said second position said segments are reversed so that said first decorative design is substantially invisible and said second decorative design is visible.

2. The clip-on earring of claim 1, wherein said one of said decorative designs includes a plurality of gem stones mounted therealong, and the other of said decorative designs does not include any gem stones.

3. The earring of claim 1, wherein said hinge comprises a first hinge member and a second hinge member pivotally connected to said first hinge member.

4. The earring of claim 3, wherein said first hinge member is carried by one of said segments at the rearward end thereof and said second hinge member is carried by the other of said segments at the rearward end thereof.

5. The earring of claim 4, wherein each of said hinge members are carried by said segments within recesses formed along said inner surfaces of said segments.

6. The earring of claim 5, wherein said hinge members are placed within said recesses such that said members are substantially flush with said inner surfaces.

7. The earring of claim 3, wherein each of said hinge members includes a pair of aligned holes through which a pin member is rotatably carried therethrough in order to pivotally mate together said hinge members.

8. The earring of claim 7, wherein said hinge mechanism also includes spring means for pivotally urging said segments towards a closed condition.

9. The earring of claim 8, wherein said spring means comprises a spring member wrapped about said pin after said pin has been deployed through said aligned holes.

10. The earring of claim 9, wherein said spring member has a first end captured by one of said segments and said first hinge member and a second end captured by the other of said segments and said second hinge member.

11. The earring of claim 7, wherein each of said segments includes a stop means located at said bottom ends for substantially preventing the spring means from being overly wound.

12. The earring of claim 1, wherein said hinge mechanism is substantially hidden from both a side elevational and front elevational view.

13. The earring of claim 12, wherein said hinge mechanism is mounted in recessed areas formed along the inner surfaces of the segments adjacent to where the segments are hingedly connected.

14. The clip-on earring of claim 1, wherein said segments cooperate to form a torus having a longitudinal axis traversing therethrough with said hinge being arranged to pivot said segments about a pivoting axis parallel to said longitudinal axis.

15. The clip-on earring of claim 14, wherein said bottom segment ends are formed with a respective abutting surfaces, said surfaces forming a stop for said earring when said segments are urged away from each other.

16. The clip-on earring of claim 1, wherein said outer surfaces are substantially convex and said inner surfaces are substantially concave.

* * * * *